US012365562B2

(12) United States Patent
Yang et al.

(10) Patent No.: US 12,365,562 B2
(45) Date of Patent: Jul. 22, 2025

(54) CABLE SUPPLY SYSTEM

(71) Applicants: Tyco Electronics (Shanghai) Co., Ltd., Shanghai (CN); TE Connectivity Services GmbH, Schaffhausen (CH)

(72) Inventors: An (Joshua) Yang, Shanghai (CN); Lvhai (Samuel) Hu, Shanghai (CN); Roberto Francisco-Yi Lu, Bellevue, WA (US)

(73) Assignees: Tyco (Electronics) Shanghai Co., Ltd., Shanghai (CN); TE Connectivity Solutions GmbH, Schaffhausen (CH)

( * ) Notice: Subject to any disclaimer, the term of this patent is extended or adjusted under 35 U.S.C. 154(b) by 319 days.

(21) Appl. No.: 17/983,011

(22) Filed: Nov. 8, 2022

(65) Prior Publication Data

US 2023/0145849 A1 May 11, 2023

(30) Foreign Application Priority Data

Nov. 8, 2021 (CN) ..... 202111313301.6

(51) Int. Cl.

| | |
|---|---|
| ***B65H 51/30*** | (2006.01) |
| ***B65H 51/20*** | (2006.01) |
| ***B65H 59/34*** | (2006.01) |

(52) U.S. Cl.

CPC ..... *B65H 51/30* (2013.01); *B65H 51/20* (2013.01); *B65H 59/34* (2013.01); *B65H 2404/1441* (2013.01); *B65H 2701/34* (2013.01)

(58) Field of Classification Search

CPC ..... B65H 51/20; B65H 51/30; B65H 57/14; B65H 59/34; B65H 2404/1441

See application file for complete search history.

(56) References Cited

U.S. PATENT DOCUMENTS

| | | | | |
|---|---|---|---|---|
| 5,366,131 | A * | 11/1994 | Hoffa | B65H 51/20 226/118.3 |
| 7,398,903 | B2 * | 7/2008 | Ulrich | B65H 51/20 226/44 |
| 2018/0305171 | A1 * | 10/2018 | Johnson | B65H 59/10 |
| 2021/0021091 | A1 * | 1/2021 | Weber | B65H 51/20 |

* cited by examiner

*Primary Examiner* — Sang K Kim
(74) *Attorney, Agent, or Firm* — Barley Snyder

(57) ABSTRACT

A cable supply system includes a cable supply device supplying a cable, a cable buffer device storing a portion of the cable supplied from the cable supply device, and a control device controlling a cable storage amount of the cable buffer device. The control device controls the cable storage amount of the cable buffer device according to a cable supply speed of the cable supply device such that a cable output speed output from the cable buffer device is equal to a predetermined speed.

20 Claims, 8 Drawing Sheets

CABLE SUPPLY SYSTEM

CROSS-REFERENCE TO RELATED APPLICATION

This application claims the benefit of the filing date under 35 U.S.C. § 119(a)-(d) of Chinese Patent Application No. 202111313301.6, filed on Nov. 8, 2021.

FIELD OF THE INVENTION

The present invention relates to a cable supply system.

BACKGROUND

A cable is commonly first wound on a cable supply reel. When supplying the cable, it is necessary to rotate the cable supply reel to release the cable coiled on it (usually called uncoiling). During the supply process, the diameter of the cable coil on the cable supply reel will gradually decrease. In addition, the diameter of different cable coils may be different, which will lead to the continuous change of the cable supply speed. As a result, the cable cannot be supplied at the predetermined constant speed.

SUMMARY

A cable supply system includes a cable supply device supplying a cable, a cable buffer device storing a portion of the cable supplied from the cable supply device, and a control device controlling a cable storage amount of the cable buffer device. The control device controls the cable storage amount of the cable buffer device according to a cable supply speed of the cable supply device such that a cable output speed output from the cable buffer device is equal to a predetermined speed.

BRIEF DESCRIPTION OF THE DRAWINGS

The features of the present invention will become more apparent by describing in detail exemplary embodiments thereof with reference to the accompanying drawings, in which.

DETAILED DESCRIPTION OF THE EMBODIMENTS

Figure 1:
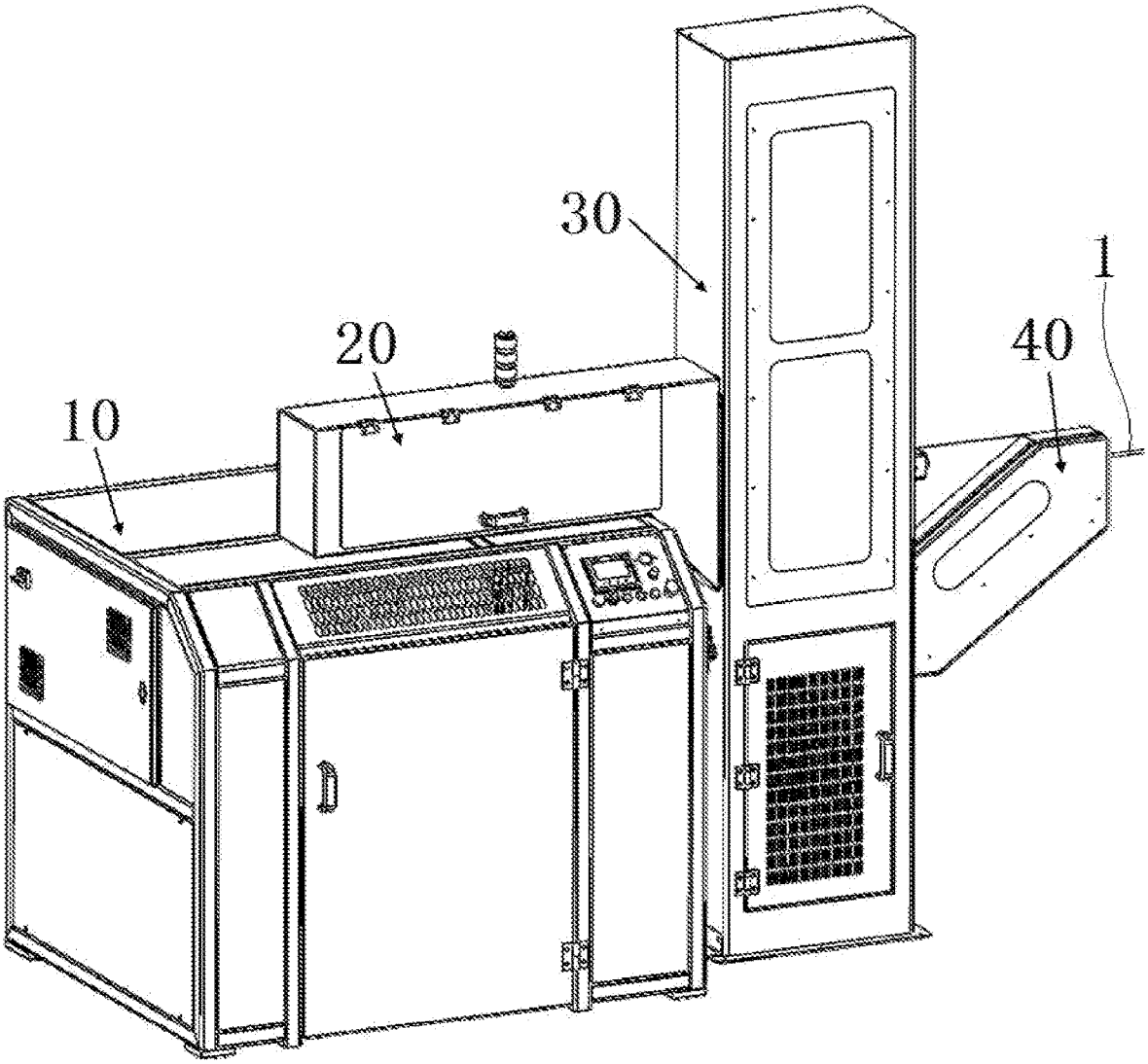
FIG. 1 is a perspective view of a cable supply system according to an embodiment.

Exemplary embodiments of the present disclosure will be described hereinafter in detail with reference to the attached drawings, wherein like reference numerals refer to like elements. The present disclosure may, however, be embodied in many different forms and should not be construed as being limited to the embodiments set forth herein; rather, these embodiments are provided so that the present disclosure will convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

FIG. 1 shows an illustrative perspective view of a cable supply system according to an exemplary embodiment of the present invention.

As shown in FIG. 1, in the illustrated embodiment, the cable supply system includes a cable supply device 10, a cable buffer device 30, and a control device. The cable supply device 10 is used to supply the cable 1. The cable buffer device 30 is adapted to store a portion of the cable supplied from the cable supply device 10. The control device is adapted to control the cable storage amount of the cable buffer device 30.

The control device may be a functional module including hardware and/or software stored on a non-transitory medium and running on a computer. The cable storage amount of the cable buffer device 30 is controlled to match the cable supply speed of the cable supply device 10 to ensure that the cable output speed output from the cable buffer device 30 is equal to a predetermined speed. That is, in the illustrated embodiment, the control device dynamically controls the cable storage amount of the cable buffer device 30 according to the cable supply speed of the cable supply device 10 to ensure that the cable output speed output from the cable buffer device 30 is equal to the predetermined speed and ensure the stable supply of the cable.

When the cable supply speed of the cable supply device 10 is greater than the predetermined speed, the control device controls the cable buffer device 30 to increase the cable storage amount to ensure that the cable output speed output from the cable buffer device 30 is equal to the predetermined speed. When the cable supply speed of the cable supply device 10 is less than the predetermined speed, the control device controls the cable buffer device 30 to reduce the cable storage amount to ensure that the cable output speed output from the cable buffer device 30 is equal to the predetermined speed.

When the cable supply speed of the cable supply device 10 is equal to the predetermined speed, the length of the cable stored by the cable buffer device 30 is equal to a first length. When the cable supply speed of the cable supply device 10 is greater than the predetermined speed, the length of the cable stored by the cable buffer device 30 is equal to a second length, and the second length is greater than the first length. When the cable supply speed of the cable supply device 10 is less than the predetermined speed, the length of the cable stored by the cable buffer device 30 is equal to a third length, and the third length is less than the first length.

Figure 6:
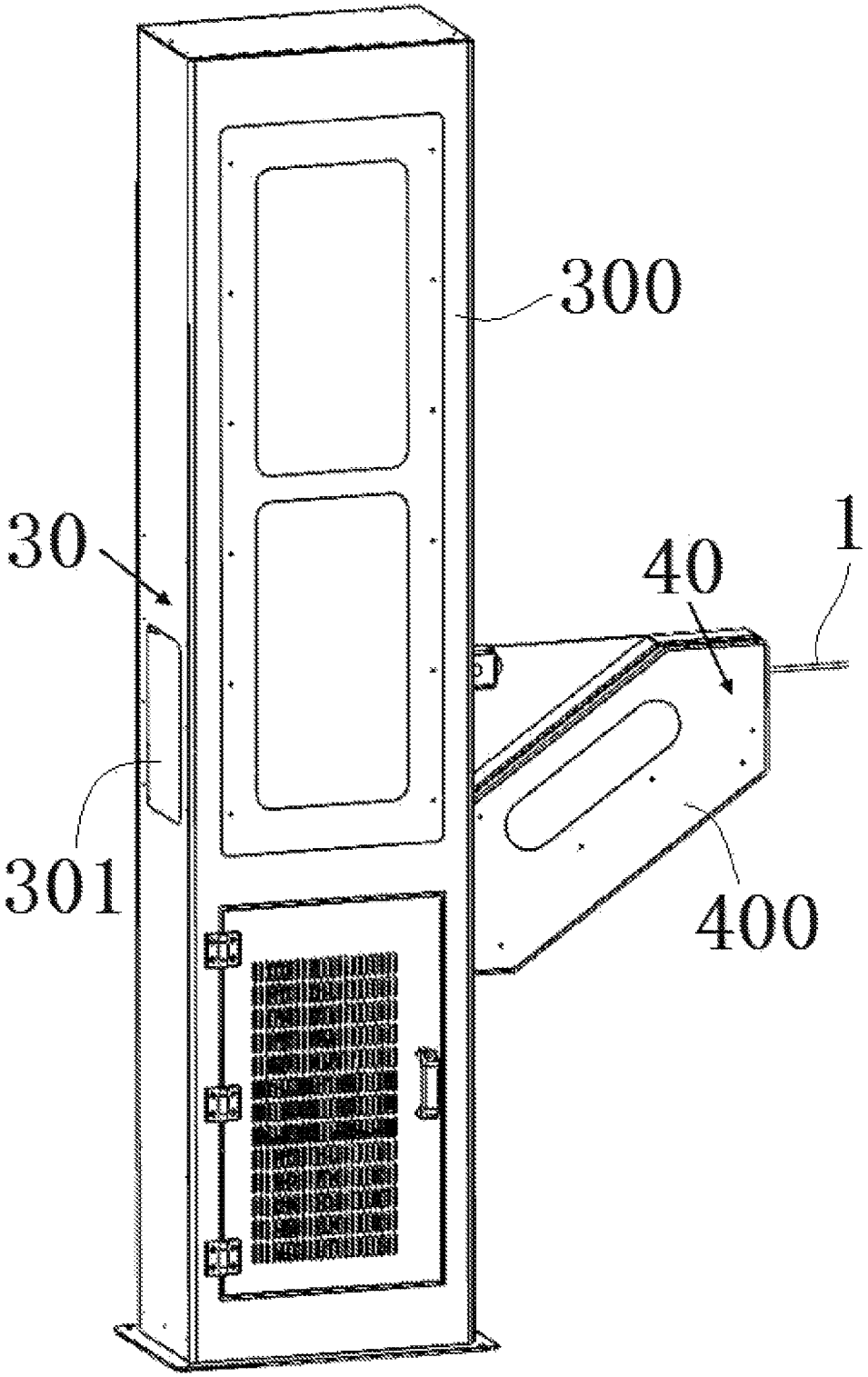
FIG. 6 is a perspective view of a cable buffer device and a cable detection device of the cable supply system.
Figure 7:
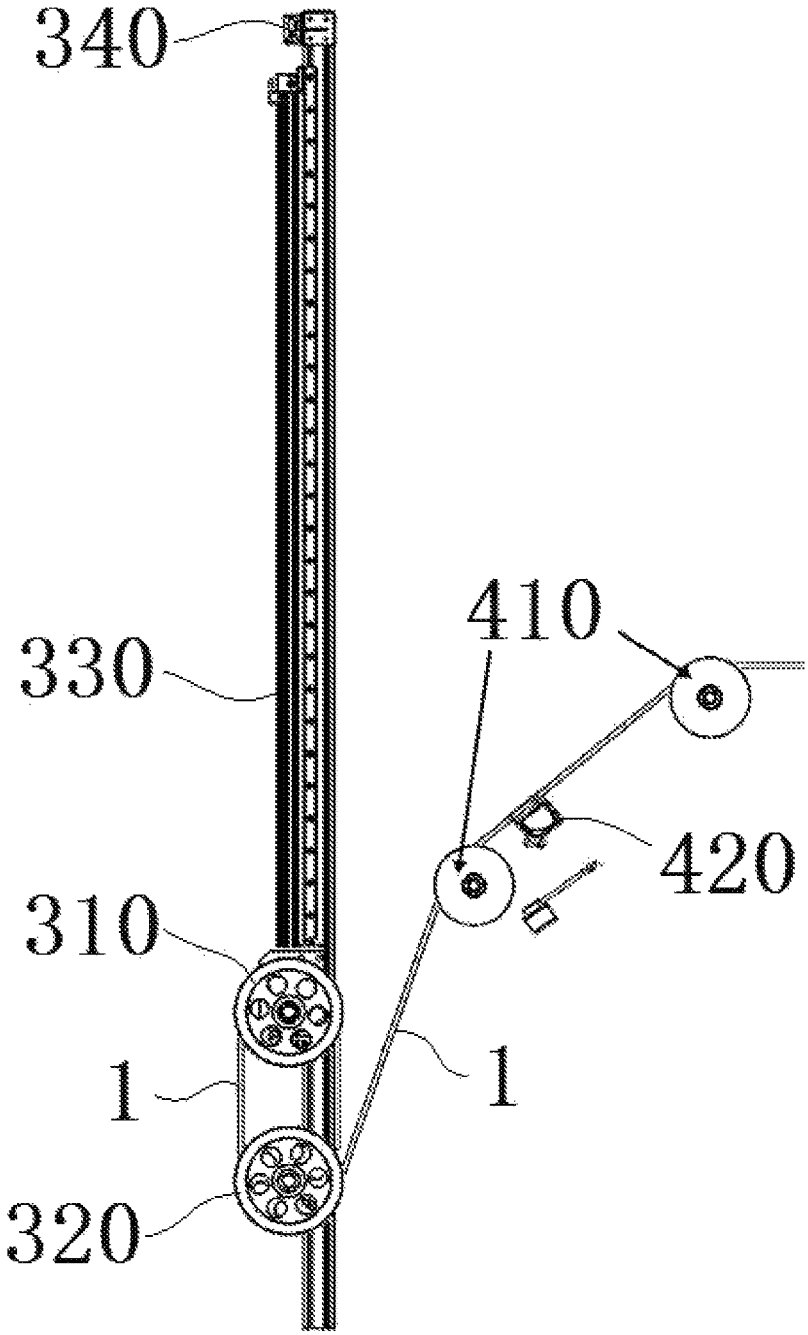
FIG. 7 is a schematic diagram of an internal structure of the cable buffer device and the cable detection device.
Figure 8A:
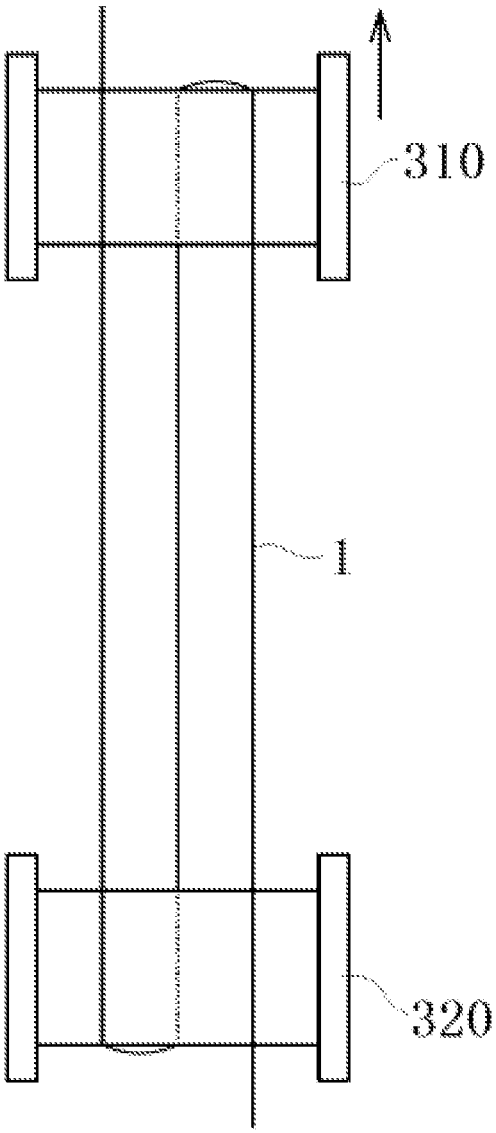
FIG. 8A is a schematic diagram of a movable pulley and a fixed pulley of the cable buffer device, in which the movable pulley is moved away from the fixed pulley.
Figure 8B:
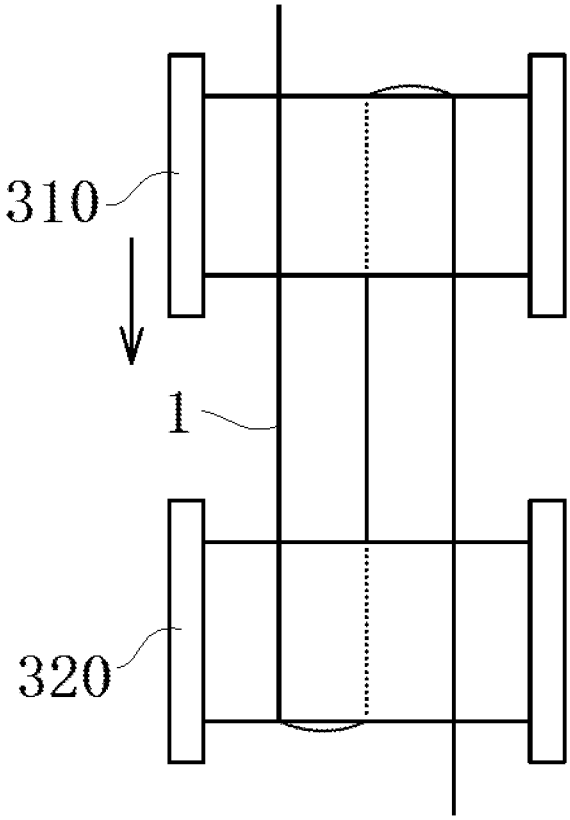
FIG. 8B is a schematic diagram of the movable pulley and the fixed pulley of the cable buffer device, in which the movable pulley is moved toward the fixed pulley.

FIG. 6 shows an illustrative perspective view of the cable buffer device 30 and the cable detection device 40 of the cable supply system shown in FIG. 1. FIG. 7 shows the internal structure diagram of the cable buffer device 30 and the cable detection device 40 of the cable supply system shown in FIG. 6. FIG. 8A shows a schematic diagram of the movable pulley 310 and the fixed pulley 320 of the cable buffer device 30 shown in FIG. 7, wherein the movable pulley 310 is moved away from the fixed pulley 320. FIG. 8B shows a schematic diagram of the movable pulley 310 and the fixed pulley 320 of the cable buffer device 30 shown in FIG. 7, wherein the movable pulley 310 is moved towards the fixed pulley 320.

As shown in FIGS. 1 and 6-8B, in the illustrated embodiment, the cable buffer device 30 includes a movable pulley 310 and a fixed pulley 320, and the cable 1 is wound on and passes through the movable pulley 310 and the fixed pulley 320. The control device adjusts the cable storage amount of the cable buffer device 30 by controlling the movement amount of the movable pulley 310 relative to the fixed pulley 320.

When the cable supply speed of the cable supply device 10 is greater than the predetermined speed, the control device controls the movable pulley 310 to move away from the fixed pulley 320 (as shown in FIG. 8A) to increase the cable storage amount of the cable buffer device 30. When the cable supply speed of the cable supply device 10 is less than the predetermined speed, the control device controls the movable pulley 310 to move in the direction close to the fixed pulley 320 (as shown in FIG. 8B) to reduce the cable storage of the cable buffer device 30.

As shown in FIGS. 1 and 6-8, the cable buffer device 30 also includes an electric cylinder 330, and the piston rod of the electric cylinder 330 is connected to the movable pulley 310 to drive the movable pulley 310 to move relative to the fixed pulley 320 and apply a predetermined tension to the cable 1. The movable pulley 310 can be moved vertically between a lower limit position and an upper limit position relative to the fixed pulley 320.

The control device is also suitable for controlling the cable supply speed of the cable supply device 10. When the movable pulley 310 is moved to the upper limit position and the cable supply speed of the cable supply device 10 is still greater than the predetermined speed, the control device reduces the cable supply speed of the cable supply device 10. When the movable pulley 310 is moved to the lower limit position and the cable supply speed of the cable supply device 10 is still less than the predetermined speed, the control device increases the cable supply speed of the cable supply device 10.

As shown in FIG. 7, the cable buffer device 30 also includes a distance sensor 340, which is used to detect the distance between the movable pulley 310 and the fixed pulley 320. The control device controls the cable storage amount of the cable buffer device 30 according to the distance detected by the distance sensor 340, so that the cable storage amount of the cable buffer device 30 matches the cable supply speed of the cable supply device 10.

As shown in FIG. 6, the cable buffer device 30 also includes a third housing 300 with a cable inlet 301 and a cable outlet. The movable pulley 310, the fixed pulley 320, the electric cylinder 330 and the distance sensor 340 are installed in the third housing 300.

Figure 2:
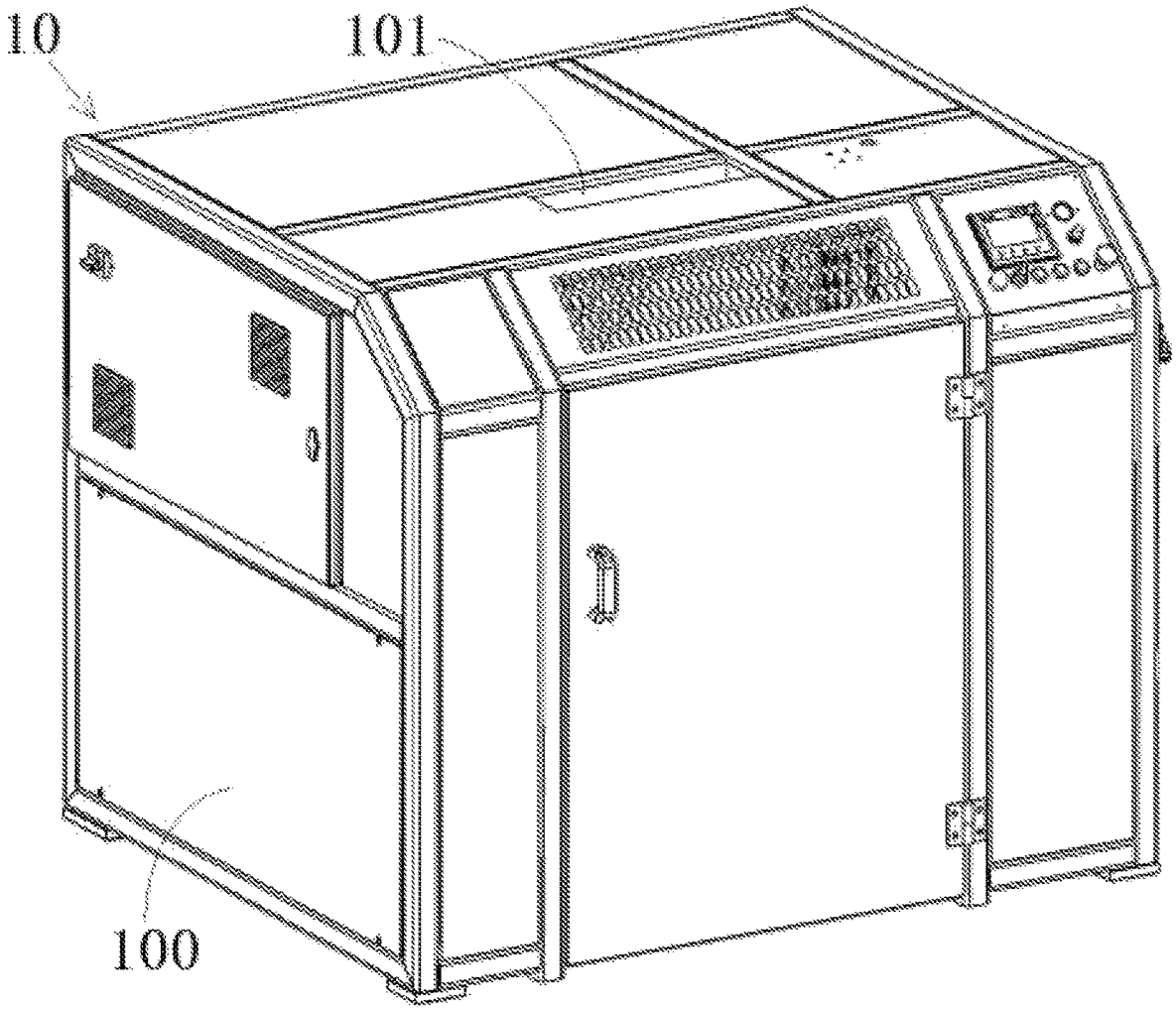
FIG. 2 is a perspective view of a cable supply device of the cable supply system.
Figure 3:
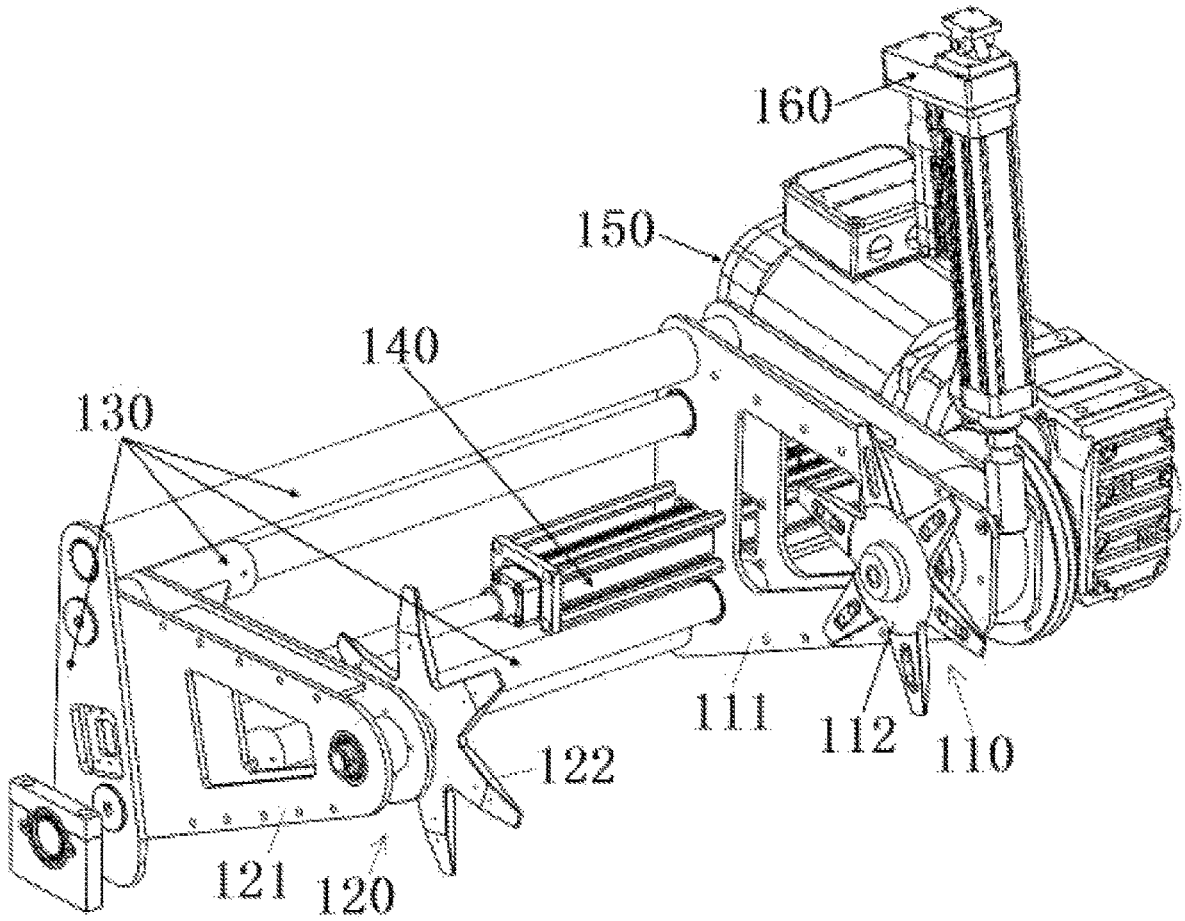
FIG. 3 is a perspective view of a clamping device, a drive motor, and a lifting cylinder of the cable supply device.
Figure 4:
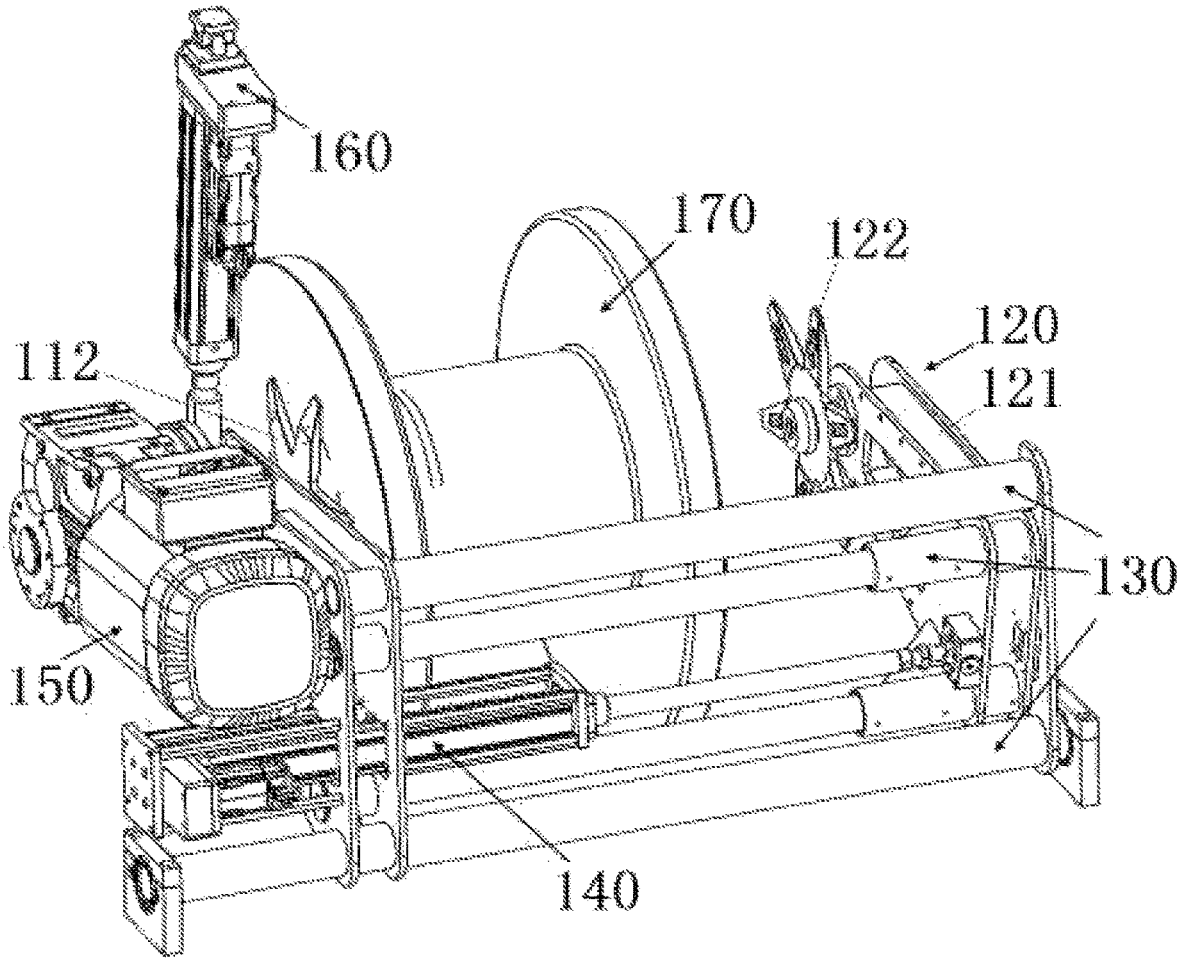
FIG. 4 is a perspective view of a cable supply reel, a clamping device, a drive motor, and a lifting cylinder of the cable supply device.

FIG. 2 shows an illustrative perspective view of the cable supply device 10 of the cable supply system shown in FIG. 1 when viewed from the outside. FIG. 3 shows an illustrative perspective view of the clamping device 110, 120, 130, 140, the drive motor 150, and the lifting cylinder 160 of the cable supply device 10 shown in FIG. 2. FIG. 4 shows an illustrative perspective view of the cable supply reel 170, the clamping device 110, 120, 130, 140, the drive motor 150 and the lifting cylinder 160 of the cable supply device 10 shown in FIG. 2.

As shown in FIGS. 3 and 4, the cable supply device 10 includes the cable supply reel 170, the clamping device 110, 120, 130, 140, and the drive motor 150. The cable 1 is wound on the cable supply reel 170. The clamping device 110, 120, 130, 140 is used to clamp the cable supply reel 170. The drive motor 150 is installed on the clamping device 110 and 120 to drive the cable supply reel 170 to rotate to supply the cable 1. The control device is adapted to control the cable supply speed of the cable supply device 10 by controlling the speed of the drive motor 150.

As shown in FIG. 3, the clamping device 110, 120, 130, 140 includes a fixed retainer 110, a movable retainer 120, a plurality of guide bars 130, and a clamping cylinder 140. The plurality of guide bars 130 are arranged in parallel with each other and spaced apart from each other. The fixed retainer 110 is fixed on one ends of the plurality of guide bars 130. The movable retainer 120 is slidably mounted on the plurality of guide bars 130 and can slide along the plurality of guide bars 130. The clamping cylinder 140 is mounted on the fixed retainer 110 to drive the movable retainer 120 to move to clamp the cable supply reel 170. The cable supply reel 170, shown in FIG. 4, is clamped between the fixed retainer 110 and the movable retainer 120, and the drive motor 150 is mounted on the fixed retainer 110.

As shown in FIG. 3, the fixed retainer 110 includes a fixed plate 111 fixed to the guide bars 130 and a first clamping piece 112 rotationally mounted to the fixed plate 111. The movable retainer 120 includes a movable plate 121 slidably mounted on the guide bars 130 and a second clamping piece 122 rotationally mounted on the movable plate 121. The cable supply reel 170 is clamped between the first clamping piece 112 and the second clamping piece 122, and the drive motor 150 and the clamping cylinder 140 are mounted on the fixed plate 111. A piston rod of the clamping cylinder 140 is connected to the movable plate 121 to drive the movable plate 121 to move. An output shaft of the drive motor 150 is connected to the second clamping piece 122 to drive the clamped cable supply reel 170 to rotate.

The cable supply device 10 also includes a first housing 100, shown in FIG. 2, and a lifting cylinder 160, shown in FIG. 3. The first housing 100 has a cable outlet 101. The clamping device 110, 120, 130, 140, the drive motor 150, and the cable supply reel 170 are accommodated in the first housing 100. The cylinder block of the lifting cylinder 160 is connected to the first housing 100, and its piston rod is connected to the fixed retainer 110 to drive the cable supply reel 170 to move in the vertical direction, so that the cable supply reel 170 can be lifted to a suspended position that is not in contact with the bottom of the first housing 100.

Figure 5:
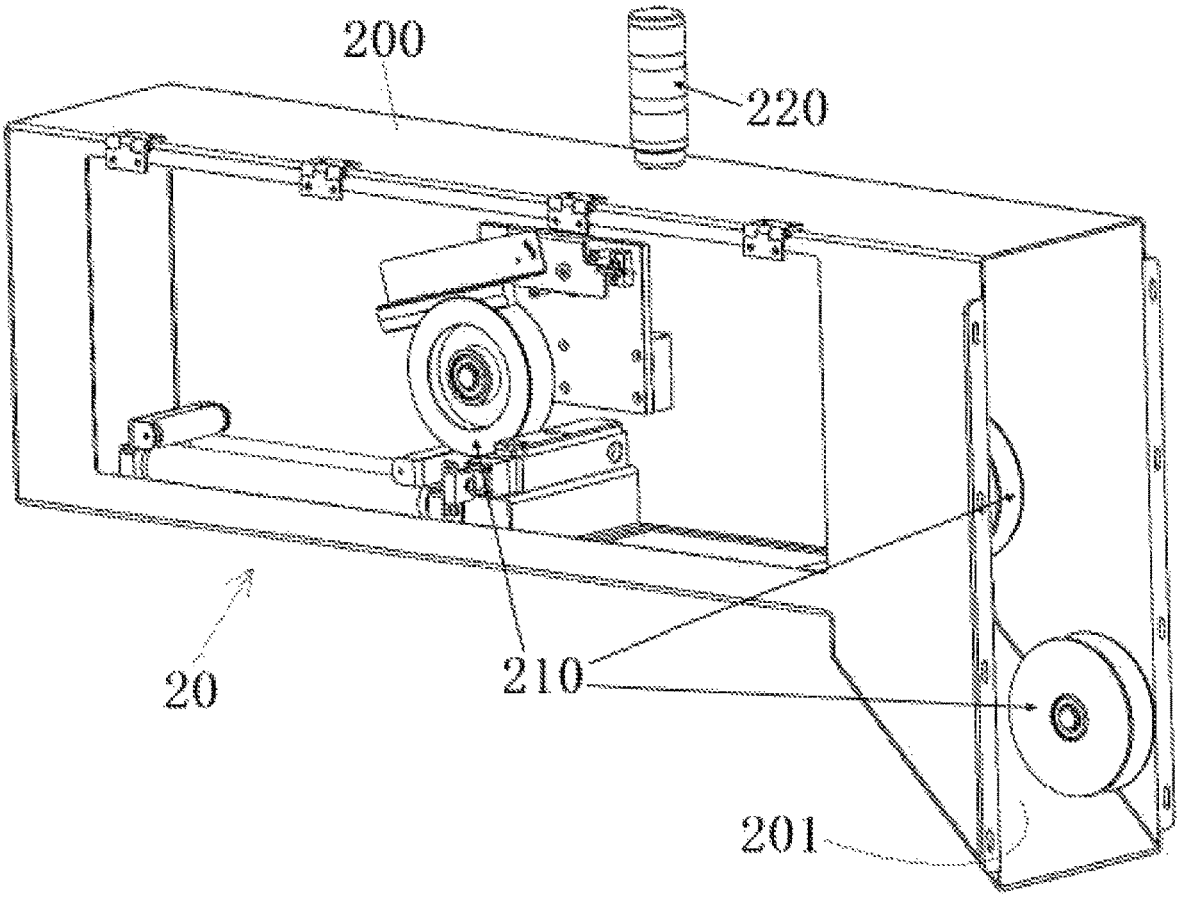
FIG. 5 is a perspective view of a cable guide device of the cable supply system.

As shown in FIGS. 1 and 5, in the illustrated embodiment, the cable supply system also includes a cable guide device 20, which is used to guide the cable 1 output from the cable supply device 10 into the cable buffer device 30. The cable guide device 20 includes a second housing 200 and a plurality of guide rollers 210. The second housing 200 has a cable inlet and a cable outlet 201. A plurality of guide rollers 210 are installed in the second housing 200 for guiding the cable 1 to the cable buffer device 30.

The cable supply system also includes a cable detection device 40, shown in FIGS. 1 and 6. The cable detection device 40 is used to detect whether there is cable 1 in the cable supply system and/or whether the position of the cable supplied in the cable supply system is correct.

As shown in FIGS. 6 and 7, in the illustrated embodiment, the cable detection device 40 includes a fourth housing 400, at least one guide wheel 410, and a detector 420. The fourth housing 400 has a cable inlet and a cable outlet. At least one guide wheel 410 is installed in the fourth housing 400 for guiding the cable 1 to the cable outlet of the fourth housing 400. The detector 420 is installed in the fourth housing 400 to detect whether the cable 1 is present and/or whether the position of the cable is correct.

As shown in FIG. 5, the cable guide device 20 also includes a state display device 220. The state display device 220 is mounted on the outside of the second housing 200 and is connected in communication with the detector 420, shown in FIG. 7, to display the detection result of the detector 420. When the detector 420 does not detect the cable 1 or when the detector 420 detects that the position of the cable 1 is incorrect, the state display device 220 displays a predetermined alarm color, such as red. When the detector 420 detects the cable 1 and the cable 1 is in the correct position, the state display device 220 displays a predetermined safety color, such as green.

It should be appreciated for those skilled in this art that the above embodiments are intended to be illustrative, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A cable supply system, comprising:

a cable supply device supplying a cable;

a cable buffer device storing a portion of the cable supplied from the cable supply device, the cable buffer device has a movable pulley, a fixed pulley, and an electric cylinder, a piston rod of the electric cylinder is connected to the movable pulley to drive the movable pulley to move relative to the fixed pulley and apply a predetermined tension to the cable; and a control device controlling a cable storage amount of the cable buffer device, the control device controls the cable storage amount of the cable buffer device according to a cable supply speed of the cable supply device such that a cable output speed output from the cable buffer device is equal to a predetermined speed.

2. The cable supply system according to claim 1, wherein when the cable supply speed of the cable supply device is greater than the predetermined speed, the control device controls the cable buffer device to increase the cable storage amount, and when the cable supply speed of the cable supply device is less than the predetermined speed, the control device controls the cable buffer device to reduce the cable storage amount.

3. The cable supply system according to claim 1, wherein when the cable supply speed of the cable supply device is equal to the predetermined speed, a length of the stored cable in the cable buffer device is equal to a first length, when the cable supply speed of the cable supply device is greater than the predetermined speed, the length of the stored cable in the cable buffer device is equal to a second length, the second length is greater than the first length, and when the cable supply speed of the cable supply device is less than the predetermined speed, the length of the stored cable in the cable buffer device is equal to a third length, the third length is less than the first length.

4. The cable supply system according to claim 1, wherein the cable passes through the movable pulley and the fixed pulley, the control device adjusts the cable storage amount of the cable buffer device by controlling a movement amount of the movable pulley relative to the fixed pulley.

5. The cable supply system according to claim 4, wherein when the cable supply speed of the cable supply device is greater than the predetermined speed, the control device controls the movable pulley to move away from the fixed pulley to increase the cable storage amount of the cable buffer device, and when the cable supply speed of the cable supply device is less than the predetermined speed, the control device controls the movable pulley to move towards the fixed pulley to reduce the cable storage of the cable buffer device.

6. The cable supply system according to claim 5, wherein the movable pulley is movable between a lower limit position and an upper limit position in a vertical direction relative to the fixed pulley.

7. The cable supply system according to claim 6, wherein the control device controls the cable supply speed of the cable supply device, the control device reduces the cable supply speed of the cable supply device when the movable pulley is moved to the upper limit position and the cable supply speed of the cable supply device is still greater than the predetermined speed, the control device increases the cable supply speed of the cable supply device when the movable pulley is moved to the lower limit position and the cable supply speed of the cable supply device is still less than the predetermined speed.

8. The cable supply system according to claim 4, wherein the cable buffer device includes a distance sensor for detecting a distance between the movable pulley and the fixed pulley, the control device controls the cable storage amount of the cable buffer device according to the distance detected by the distance sensor, so that the cable storage amount of the cable buffer device matches the cable supply speed of the cable supply device.

9. The cable supply system according to claim 8, wherein the cable buffer device includes a third housing having a cable inlet and a cable outlet, the movable pulley, the fixed pulley, the electric cylinder, and the distance sensor are installed in the third housing.

10. The cable supply system according to claim 1, wherein the cable supply device includes:

a cable supply reel with a cable wound on the cable supply reel;

a clamping device clamping the cable supply reel; and a drive motor mounted on the clamping device and driving the cable supply reel to rotate and supply the cable, the control device controls the cable supply speed of the cable supply device by controlling the speed of the drive motor.

11. The cable supply system according to claim 10, wherein the clamping device includes:

a plurality of guide bars arranged in parallel to and spaced from each other;

a fixed retainer fixed on a plurality of ends of the plurality of guide bars;

a movable retainer slidably mounted on the plurality of guide bars and slidable along the plurality of guide bars; and a clamping cylinder mounted on the fixed retainer and driving the movable retainer to clamp the cable supply reel, the cable supply reel is clamped between the fixed retainer and the movable retainer, the drive motor is installed on the fixed retainer.

12. The cable supply system according to claim 11, wherein the fixed retainer includes a fixed plate fixed to the guide bars and a first clamping piece rotationally mounted on the fixed plate, the movable retainer has a movable plate slidably mounted on the guide bars and a second clamping piece rotationally mounted on the movable plate, the cable supply reel is clamped between the first clamping piece and the second clamping piece, the drive motor and the clamping cylinder are installed on the fixed plate, a piston rod of the clamping cylinder is connected to the movable plate to drive the movable plate to move, and an output shaft of the drive motor is connected to the second clamping piece to drive the clamped cable supply reel to rotate.

13. The cable supply system according to claim 11, wherein the cable supply device includes:

a first housing having a cable outlet and accommodating the clamping device, the drive motor, and the cable supply reel; and a lifting cylinder having a cylinder body connected to the first housing and a piston rod connected to the fixed retainer, the lifting cylinder moves the cable supply reel in the vertical direction, so as to lift the cable supply reel to a suspended position that is not in contact with a bottom of the first housing.

14. The cable supply system according to claim 1, further comprising a cable guiding device guiding the cable output from the cable supply device into the cable buffer device.

15. The cable supply system according to claim 14, wherein the cable guiding device includes:

a second housing having a cable inlet and a cable outlet; and a plurality of guide rollers installed in the second housing, the plurality of guide rollers guide the cable output from the cable supply device into the cable buffer device.

16. The cable supply system according to claim 15, further comprising a cable detection device detecting whether there is a cable in the cable supply system and/or whether a position of the cable supplied in the cable supply system is correct.

17. The cable supply system according to claim 16, wherein the cable detection device includes:

a fourth housing having a cable inlet and a cable outlet;

a guide wheel installed in the fourth housing to guide the cable to the cable outlet of the fourth housing; and a detector installed in the fourth housing to detect whether there is a cable in the fourth housing and/or whether the position of the cable is correct.

18. The cable supply system according to claim 17, wherein the cable guiding device has a state display device installed on an outside of the second housing and connected with the detector in communication to display a detection result of the detector, and when the detector does not detect the cable or when the detector detects that the position of the cable is incorrect, the state display device displays a predetermined alarm.

19. A cable supply system, comprising:

a cable supply device supplying a cable;

a cable buffer device storing a portion of the cable supplied from the cable supply device, the cable buffer device has a movable pulley, a fixed pulley, and an electric cylinder, a piston rod of the electric cylinder is connected to the movable pulley to drive the movable pulley to move relative to the fixed pulley and apply a predetermined tension to the cable; and a control device controlling a cable storage amount of the cable buffer device, the cable storage amount of the cable buffer device is controlled to match a cable supply speed of the cable supply device such that a cable output speed output from the cable buffer device is equal to a predetermined speed.

20. A cable supply system, comprising:

a cable supply device supplying a cable, the cable supply device has a cable supply reel with a cable wound on the cable supply reel, a clamping device clamping the cable supply reel, and a drive motor mounted on the clamping device and driving the cable supply reel to rotate and supply the cable;

a cable buffer device storing a portion of the cable supplied from the cable supply device; and a control device controlling a cable supply speed of the cable supply device by controlling the speed of the drive motor and a cable storage amount of the cable buffer device, the control device controls the cable storage amount of the cable buffer device according to the cable supply speed such that a cable output speed output from the cable buffer device is equal to a predetermined speed.

* * * * *